United States Patent [19]

Thompson et al.

[11] Patent Number: 4,703,747

[45] Date of Patent: Nov. 3, 1987

[54] EXCESS AIR CONTROL

[75] Inventors: Kevin D. Thompson, Indianapolis; Daniel J. Dempsey, Carmel, both of Ind.; Robert W. Peitz, Jr., Fayetteville, N.Y.

[73] Assignee: Carrier Corporation, Syracuse, N.Y.

[21] Appl. No.: 908,476

[22] Filed: Sep. 17, 1986

[51] Int. Cl.[4] ..... F24H 3/00

[52] U.S. Cl. ..... 126/112; 431/2; 431/3; 236/1 B; 236/15 C; 165/16; 165/31

[58] Field of Search ..... 126/112; 431/2, 3, 6; 236/11, 15 C, 17, DIG. 9, DIG. 8; 165/16, 31

[56] References Cited

U.S. PATENT DOCUMENTS 2,666,584 1/1954 Kliever ..... 236/DIG. 8 X
3,284,615 11/1966 Yetter ..... 236/DIG. 8 X
4,174,941 11/1979 Parkes ..... 431/3
4,406,397 9/1983 Kamata et al. ..... 236/DIG. 9 X

*Primary Examiner*—Larry Jones
*Attorney, Agent, or Firm*—Dana F. Bigelow

[57] ABSTRACT

Method and apparatus for maintaining excess air control in a gas furnace. A pressure switch is placed across a heat exchanger to indicate when, while accelerating the inducer motor speed during purging operation, the pressure drop reaches a predetermined level. When that occurs, the motor speed is sensed and recorded. When the furnace is subsequently fired, the desired inducer motor speed is obtained by modifying the recorded motor speed on a correction factor derived from empirical data obtained from a gas furnace operating under selective variable conditions.

7 Claims, 5 Drawing Figures

EXCESS AIR CONTROL

BACKGROUND OF THE INVENTION

This invention relates generally to gas furnaces and, more particularly, to control of excess air in a gas furnace having a variable speed inducer motor.

In the operation of a gas-fired furnace, combustion efficiency can be optimized by maintaining the proper ratio of the gas input rate and the combustion air flow rate. Generally, the ideal ratio is offset somewhat for safety purposes by providing for slightly more combustion air (i.e., excess air) than that required for optimum combustion efficiency conditions. In order that furnace heat losses are minimized, it is important that this excess air level is controlled.

Since the pressure drop across the heat exchanger is proportional to excess air, it is maintained at a predetermined constant level for a given gas input rate. One method of maintaining such a constant pressure drop is shown in U.S. patent application Ser. No. 802,273 filed on Nov. 26, 1985 now abandoned by the assignee of the present invention. In that application, sensors are provided at the inlet and the outlet of the heat exchanger, and a pressure transducer is provided to receive signals from those sensors to calculate a pressure drop signal which is then provided to the furnace control to responsively vary the speed of the inducer motor so as to maintain a constant pressure drop and thereby maintain the excess air at a constant level. One of the problems with the use of such a transducer is its relatively high cost. Further, the reliability of such a transducer was found to be less than that desired because of apparent thermal instabilities.

It has become common practice in gas-fired furnaces to provide for two different firing stages where each stage has its own gas input rate. Two speed operation can be accomplished with a fixed rate, two speed motor to drive the draft inducer motor and blower motor; however, the electrical consumption of such motors limited to two speeds while operating at low speed would be significantly greater than that of a variable speed electronically commutated motor (ECM), for example. Further, since the inducer motor would operate at only two fixed speeds, the system could not adapt to variable operating and system conditions such as, for example, a variable length of vent system, such that the level of excess air could not be controlled to the degree desired unless the system was tuned for the particular installation.

It is therefore an object of the present invention to provide an improved method and apparatus for controlling the excess air in a gas-fired furnace without the need for field tuning the combustion system.

Another object of the present invention is the provision in a gas-fired furnace for controlling the level of excess air without the use of a pressure transducer.

Yet another object of the present invention is the provision in a gas-fired furnace for controlling the level of excess air in a manner which takes into account the use of variable length vents.

Still another object of the present invention is the provision for controlling a variable speed motor so as to maintain desirable levels of excess air when operating with either a single or multi-stage system.

Yet another object of the present invention is the provision in a gas-fired furnace for an excess air control system which is economical to manufacture and effective in use.

These objects and advantages become more readily apparent upon reference to the following description when taken in conjunction with the appended drawings.

SUMMARY OF THE INVENTION

Briefly, in accordance with one aspect of the invention, there is provided in the furnace heat exchanger, at least one pressure switch, which is responsive at a pressure level commensurate with a desired theoretical level of excess air when operating in a firing condition. During the purging cycle, the inducer motor is accelerated to increase the pressure in the heat exchanger such that the pressure switch closes when its make point is reached. As the switch closes, the inducer motor speed is sensed and recorded by a microprocessor. After purging, the furnace is fired and the inducer motor is allowed to stabilize. After a short period of time the inducer motor speed is reduced to a level which is based on the recorded motor speed and on a formula derived from data experimentally obtained from an exemplary operating system demonstrating the desired excess air level under high fired conditions. In this way, the pressure switch is used during pre-ignition operation to obtain a motor speed which can be subsequently applied to obtain the desired operating speed of the inducer motor under firing conditions.

In the drawings as hereinafter described, a preferred embodiment is depicted. However, various other modifications and alternate constructions can be made thereto without departing from the true spirit and scope of the invention.

DESCRIPTION OF THE PREFERRED EMBODIMENT

Figure 1:
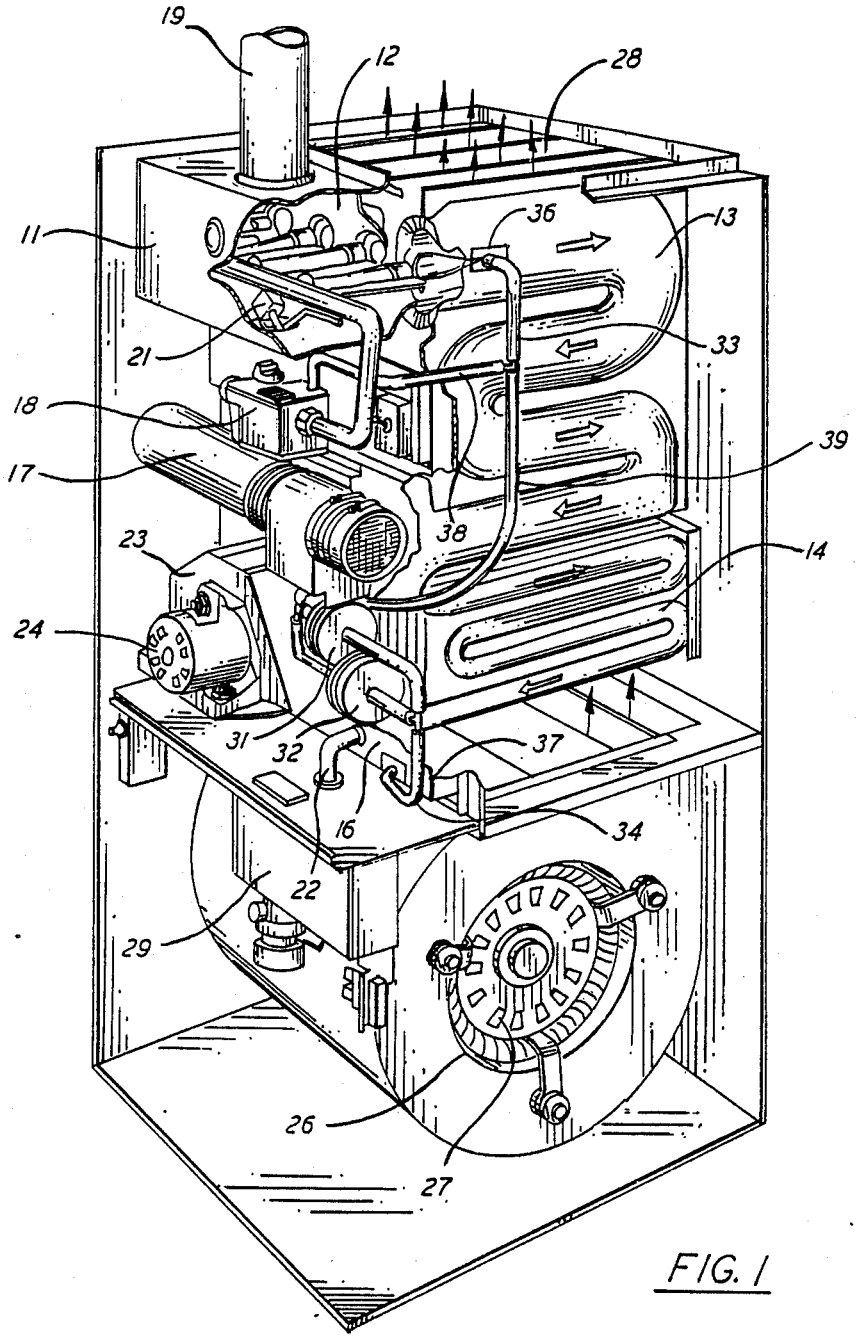
FIG. 1 is a perspective view of a gas furnace having the present invention incorporated therein.

Referring now to FIG. 1, there is shown a furnace of the general type with which the present invention can be employed. A burner assembly 11 communicates with a burner box 12 of a primary heat exchanger 13. Fluidly connected at the other end of the primary heat exchanger 13 is a condensing heat exchanger 14 whose discharge end is fluidly connected to a collector box 16 and an exhaust vent 17. In operation, a gas valve 18 meters the flow of gas to the burner assembly 11 where combustion air from the air inlet 19 is mixed and ignited by the ignition assembly 21. The hot gas is then passed through the primary heat exchanger 13 and the condensing heat exchanger 14 as shown by the arrows. The relatively cool exhaust gases then pass through the collector box 16 and the exhaust vent 17 to be vented to the atmosphere, while the condensate flows from the collector box 16 through a condensate drain line 22 from where it is suitably drained to a sewer connection or the like. Flow of the combustion air into the air inlet 19, through the heat exchangers 13 and 14, and the exhaust vent 17 is enhanced by a draft inducer blower 23 which is driven by a motor 24 in response to control signals from the microprocessor.

The household air is drawn into a blower 26 which is driven by a drive motor 27, again in response to signals received from the microprocessor. The discharge air from the blower 26 passes over the condensing heat exchanger 14 and the primary heat exchanger 13, in counterflow relationship with the hot combustion gases, to thereby heat up the household air, which then flows from the discharge opening 28 to the duct system within the home.

The microprocessor mentioned hereinabove is contained in the microprocessor control assembly 29. In response to electrical signals from the thermostat, and from other signals to be discussed hereinafter, the microprocessor control assembly 29 operates to control the inducer motor 24 and the blower motor 27 in such a way as to promote an efficient combustion process at two different firing rates.

Figure 2:
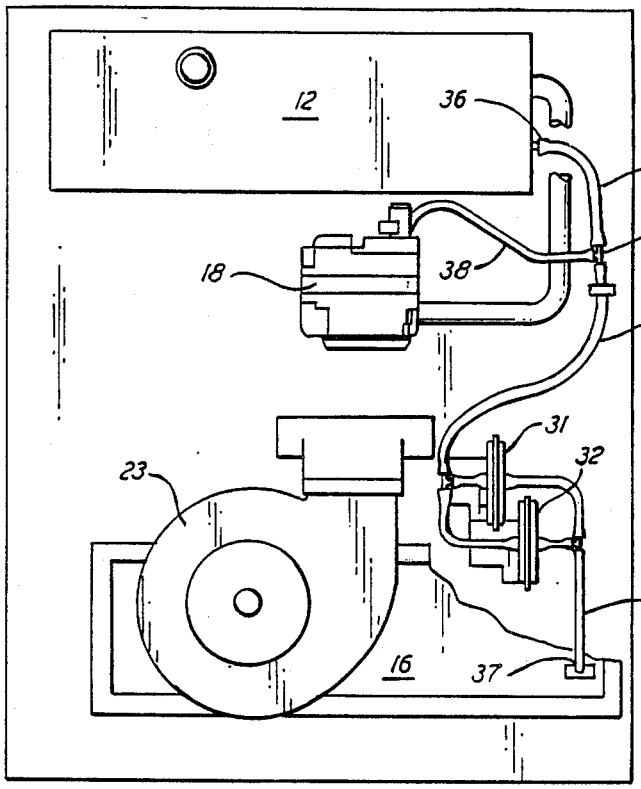
FIG. 2 is a schematic illustration of the two installed pressure switches thereof as applied to the heat exchanger system.

To aid in the control of excess air, a pair of pressure switches 31 and 32 are placed across burner box 12 and the collector box 16, respectively, so as to permit the measurement of the pressure drop across the heat exchanger system. The switches 31 and 32 are mechanically connected within the system to sense the heat exchanger pressure drop shown as in FIG. 2.

As will be seen, a burner box tube 33 leads from the pressure tap 36 and a collector box tube 34 leads from the pressure tap 37. Fluidly connected therebetween, in parallel relationship, are the low pressure switch 31 and high pressure switch 32. These switches are calibrated to make, or close, at specific pressure differentials as determined in a manner which will be more fully described hereinafter. Switches that have been found satisfactory for use in this manner are commercially available from Tridelta as part numbers FS 6003-250 (high pressure) and FS 6002-249 (lqw pressure).

Since the system is normally operating under negative pressure conditions, it is necessary to fluidly connect the vent of gas valve 18 with tube 38 to tubes 33 and 39 via a "T" fitting 40 so as to reference low pressure switch 31, high pressure switch 32, and gas valve 18 to the negative pressure inherent in burner box 12 while inducer motor 24 is in operation.

Since the pressure drop across the heat exchangers is indicative of the level of excess air in the combustion system, the low and high pressure switches 31 and 32 are used to determine when the level of excess air falls below the minimum desired theoretical levels for low and high firing conditions, respectively. For example, the low pressure switch 31 is so calibrated that it will close at the point when the excess air level is equal to the desired theoretical value for low firing conditions. At that time, the closing of the switch causes a signal to be transmitted to the microprocessor, which in turn initiates a sensing and recording of the inducer motor speed, RPM 1. Similarly, as the speed of the inducer motor is increased, the level of excess air is increased until it finally reaches the desired theoretical value for high firing conditions, at which time the high pressure switch 32 closes and a signal is sent to the microprocessor. The inducer motor speed is again sensed and recorded at RPM 2. These speeds RPM 1 and RPM 2 are then mathematically altered to obtain the desired motor speeds in accordance with the present invention.

Figure 3:
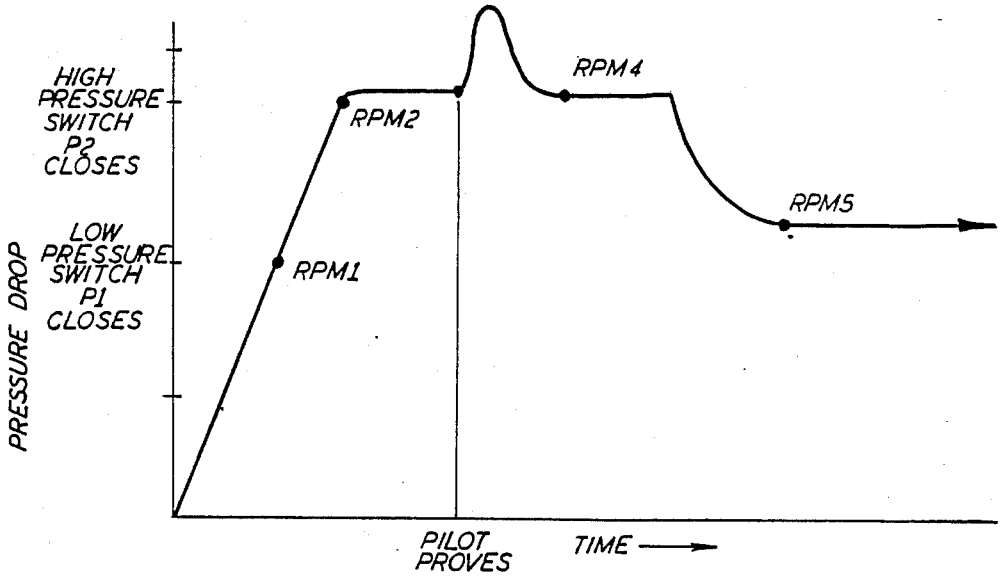
FIGS. 3–5 are graphic illustrations of changes in the inducer motor speeds during typical cycles of operation.
Figure 4:
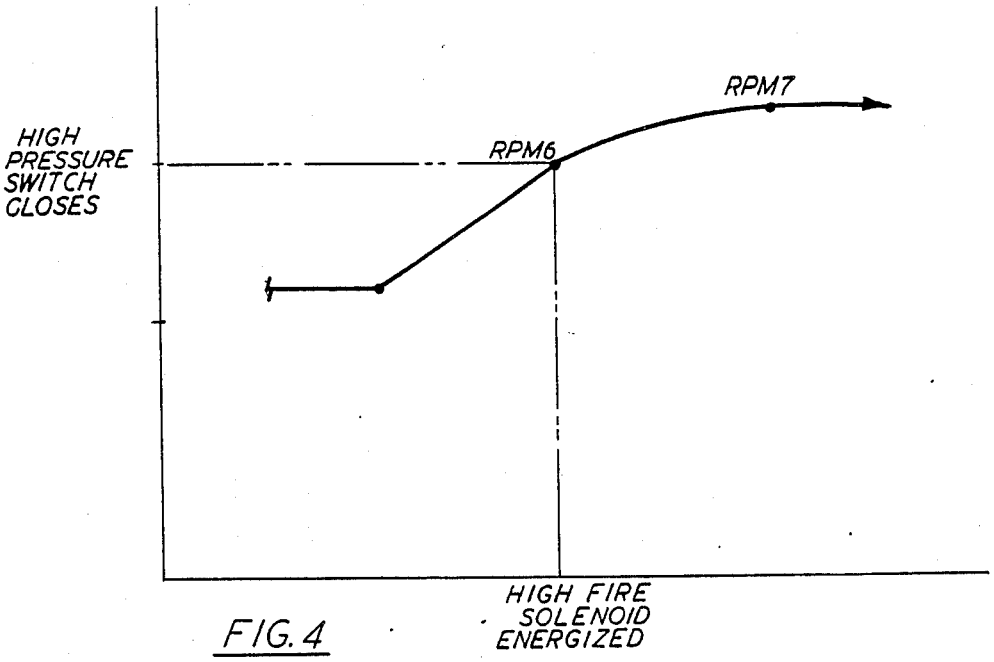

Referring now to FIG. 3, a typical cycle of operation will be described. Upon a call for heat, the control checks the status of the high and low pressure switches 32 and 31. If both of the switches are open as they should be, then the inducer motor is accelerated until the pressure drop equals $P_1$, at which time the low pressure switch 31 is closed and the inducer motor speed RPM 1 is recorded. The inducer motor speed is allowed to continue to accelerate until the pressure drop equals $P_2$, at which time the high pressure switch 32 closes and the inducer motor speed RPM 2 is recorded. The microprocessor control 29 then calculates the ratio of the inducer speeds at low and high firing switch closure points as follows:

$$\text{RATIO} = \frac{\text{RPM 1}}{\text{RPM 2}} \qquad \text{(Eq. 1)}$$

The RATIO is then recorded for subsequent application.

After the high pressure switch 32 closes, the system undergoes a vent purge and the pilot is ignited by the furnace control. Shortly after the pilot proves, and the main burners ignite, the control then calculates RPM 4 using RPM 2 as will be described more fully hereinafter, after which it reduces the inducer motor speed to RPM 4.

It will be understood that when ignition occurs, the bulk temperature of the heat exchange system increases and the bulk density decreases. This, in turn causes a substantial increase in the pressure drop as shown in FIG. 3. In order to reduce the pressure drop to the level at which RPM 2 was sensed, the speed of the inducer motor must be reduced accordingly. However, it is not obvious as to how much that speed can be reduced. The various factors that are involved include: the difference in temperature and density between flue gas and air, the gas valve opening characteristics, and the length of the system vent.

In order to determine nominal operating points for various systems a pressure drop $P_5$ commensurate with desired theoretical level of excess air was used. An exemplary system was experimentally run under various operating conditions (i.e., warm and cold starts for each of minimum and maximum length vent conditions), with RPM 1–RPM 4, as well as the heat exchanger pressure drop (HXDP), being recorded. The resulting data was then analyzed and modified to make the heat exchanger pressure drop repeatable from cycle to cycle for minimum and maximum vent lengths. For this purpose, a nominal high firing rate heat exchanger pressure drop of 0.72 inches w.c. was used. Thus, where the variation from this nominal value was above a predetermined threshold, the following equation was applied to correct the RPM 4 values:

$$\text{RPM}_{cor} = \text{RPM} \times \sqrt{\frac{.72}{HXDP}} \qquad \text{(Eq. 2)}$$

Taking the average of the experimental data so obtained, the corrected RPM 4 values were determined to be related to RPM 2 values, for minimum and maximum vent conditions, as shown in Table I.

TABLE I

| | RPM 2 | RPM 4 |
|---|---|---|
| Min. Vent | 2574 | 2469 |
| Max. Vent | 3429 | 3124 |

Assuming now, a linear relationship between minimum and maximum vent conditions, a best fit straight line equation using RPM 2 and RPM 4 values was determined as follows:

$$RPM\ 4 = 497.11 + (0.766 \times RPM\ 2) \quad \text{(Eq. 3)}$$

The speed of the inducer motor is therefore held at RPM 4 until the end of the high firing period. When the heat exchanger has been warmed up and the blower motor has been calibrated, the control then switches to a low firing condition. This is accomplished by first calculating inducer motor speed RPM 5 using inducer motor speed RPM 4. The blower motor speed is then reduced to a low firing speed and the furnace control reduces the inducer motor speed to RPM 5, where:

$$RPM\ 5 = RPM\ 4 \times RATIO \quad \text{(Eq. 4)}$$

Where: RATIO is defined as Equation 1, measured during vent purge.

As the inducer motor speed is reduced from RPM 4, the high pressure switch 32 opens and the high firing solenoid is de-energized. The inducer motor speed is thus reduced to RPM 5 and remains at that level during the period of low firing operation. If the thermostat is not satisfied within a prescribed period of time, the control will switch from a low firing to a high firing condition. This is done by first accelerating the inducer motor until the high firing pressure switch closes and thereby energizes the high firing solenoid. The speed of the inducer motor RPM 6 is then recorded. The blower then goes to high firing speed and the control increases the inducer motor speed to RPM 7. The relationship between RPM 6 and RPM 7 values are experimentally determined in the same manner as described for RPM 2 and RPM 4 above, with the average RPM's for a minimum and maximum vent lengths being shown in Table II.

TABLE II

| | RPM 6, 8 | RPM 7, 9 |
|---|---|---|
| Min. Vent | 2398 | 2482 |
| Max. Vent | 3044 | 3080 |

Again, assuming a relationship between minimum and maximum vent conditions, a best fit straight line equation using RPM 6 and RPM 7 was determined to be:

$$RPM\ 7 = 262.18 + (0.926 \times RPM\ 6) \quad \text{(Eq. 5)}$$

The inducer motor speed is then held constant at RPM 7 for high firing operation until such time as the thermostat conditions are met or the system again changes to a low firing operating condition.

Figure 5:
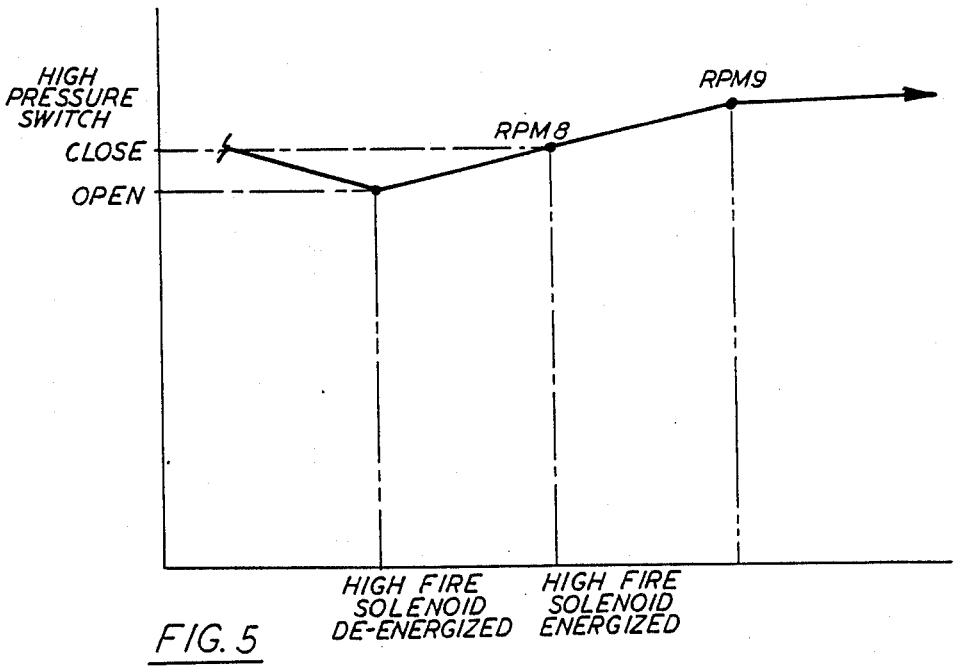

If, for example, an obstruction was temporarily placed over the system vent, the pressure drop would be reduced to the point where the high pressure switch 32 would open, causing the high firing solenoid to be de-energized. This is necessary because of the reduced combustion airflow as shown in FIG. 5. The control then causes the inducer motor speed to be increased until the high pressure switch 32 recloses and re-energizes the high fire solenoid. At that time, the inducer motor speed RPM 8 is recorded and the furnace control increases the inducer motor speed to RPM 9 where:

$$RPM\ 9 = 262.18 + (0.926 \times RPM\ 8) \quad \text{(Eq. 6)}$$

As will be seen, the inducer motor speed RPM 9 is determined as a function of the speed RPM 8 with the use of the same mathematical relationship found between RPM 6 and RPM 7 as expressed in Equation 5.

It will be understood that throughout the operation described hereinabove, controlling limits are operative in the various operating modes, and the relevant conditions are monitored such that if the limits are exceeded, a failure is indicated and the cycle is readjusted accordingly. For example, during the period of initial acceleration to RPM 1 as shown in FIG. 3, if either the low pressure switch does not close within a prescribed period of time or the RPM 1 value is outside its prescribed limits, a fault is signalled, the unit shuts down and tries again. If the high pressure switch closes before the low pressure switch closes, a fault is signalled and the unit locks out. Similar limits and modified operating modes are provided during the other phases of operation to ensure that the system is operating within the intended parameters.

While the present invention has been described in terms of use with a two stage system, it should be understood that certain aspects thereof can just as well be used with a single or other multi-stage systems. For example, while the Equations 3, 4, 5 and 6 have been applied to obtain the desired inducer motor operating speeds for high firing conditions in a two stage system, they are equally applicable for use in determining the inducer motor speeds for operation under firing conditions in a single or other multi-stage systems.

It will be understood that the present invention has been described in terms of a preferred embodiment. However, it may take on any number of other forms while remaining within the scope and intent of the invention.

What is claimed is:

1. In a gas furnace of the type having a heat exchanger and a variable speed inducer motor, an improved method establishing a desired level of excess air comprising the steps of:

using empirical data obtained from a gas furnace operating under selective variable conditions, establishing a calibration factor for obtaining a desired excess air level for a furnace of nominal design characteristics:

providing a pressure switch that is responsive to a selected pressure drop level in the heat exchanger, said pressure drop level being selected so as to be commensurate with a theoretically desired excess air level under firing operating conditions;

accelerating the variable speed inducer motor until said pressure switch closes and recording the motor speed at that time; and applying said calibration factor to said recorded motor speed to obtain a desired induced motor speed.

2. A method as set forth in claim 1 including the further step of maintaining said desired motor speed to obtain the desired level of excess air.

3. In a gas furnace of the type having a heat exchanger and variable speed inducer motor, apparatus for maintaining a desired excess air level during fired operating conditions comprising:

means for sensing when the pressure drop across the heat exchanger reaches a predetermined level while accelerating the inducer motor during purging operating conditions;

means for sensing and recording the actual inducer motor speed when said predetermined level is reached; and means for calculating, as the function of said actual inducer motor speed and as the function of performance data experimentally obtained, a desired inducer motor speed for operation under fired operating conditions.

4. Apparatus as set forth in claim 3 wherein said predetermined level is that level which is commensurate with a theoretical desired excess air level under fired operating conditions.

5. Apparatus as set forth in claim 3 wherein said means for sensing and recording comprises a microprocessor.

6. In a gas furnace of the type having a heat exchanger and a variable speed inducer motor, a method for maintaining a desired excess air level comprising the steps of:

while accelerating the inducer motor during purging operation, sensing when pressure drop across the heat exchanger reaches a predetermined level;

sensing and recording the actual inducer motor speed when said predetermined level is reached; and calculating as a function of said actual motor speed and as a function of performance data experimentally obtained, a desired inducer motor speed for operation under fired operating conditions.

7. A method as set forth in claim 6 wherein said predetermined level is determined as being commensurate with a theoretically desired excess air level under fired operating conditions.

* * * * *